United States Patent [19]

Burlett

[11] 4,278,229

[45] Jul. 14, 1981

[54] FULL HEIGHT SEWER SYSTEM MANHOLE INVERT FORM ASSEMBLY WITH ANGULARLY ADJUSTABLE INTERSECTING FLOW PATH

[76] Inventor: Frederick E. Burlett, Benson, Vt.

[21] Appl. No.: 56,673

[22] Filed: Jul. 11, 1979

[51] Int. Cl.[3] ..... B28B 7/02

[52] U.S. Cl. ..... 249/11; 249/102; 249/145; 249/177

[58] Field of Search ..... 249/102, 145, 177, 11

[56] References Cited

U.S. PATENT DOCUMENTS

| | | | |
|---|---|---|---|
| 3,363,876 | 1/1968 | Moore | 249/145 |
| 3,734,450 | 5/1973 | Lengel | 249/145 X |
| 4,085,918 | 4/1978 | Wilkerson | 249/177 X |
| 4,103,862 | 8/1978 | Moore | 249/145 X |
| 4,119,291 | 10/1978 | Polito | 249/11 |
| 4,143,849 | 3/1979 | Good | 249/11 |

*Primary Examiner*—Thomas P. Pavelko
*Attorney, Agent, or Firm*—Sughrue, Rothwell, Mion, Zinn and Macpeak

[57] ABSTRACT

A telescoping, U-shaped straight through, primary flow invert form may be lenghtened or shortened to meet the diameter of the cylindrical manhole and is mounted at opposite ends to the aligned main flow inlet and outlet pipes of the manhole. Longitudinally projecting bottom and opposed side invert tabs located at the ends of the straight through invert form contact the insides of the inlet and outlet pipes, respectively, to center the form. Slide guides, each carrying a retainer tab, adjust the retaining tabs longitudinally to position them within respective pipes at respective ends of the form for preventing lifting of the invert form during concrete pouring within the manhole. An angularly adjustable, intersecting side flow invert form projects from another pipe opening to the manhole at some angle to the straight through form and includes interlocking, axially slidable, opposed section halves. Straps fixed at one end to the section halves permit clip locking or latching of the invert form leading edges in contact with the outside wall of the straight through form. Inverted U-shaped telescoping struts between the opposed interlocking, slidable section halves latch the side flow invert to the side of the through form opposite that receiving the clip borne by the strap.

8 Claims, 11 Drawing Figures

FIG. 1
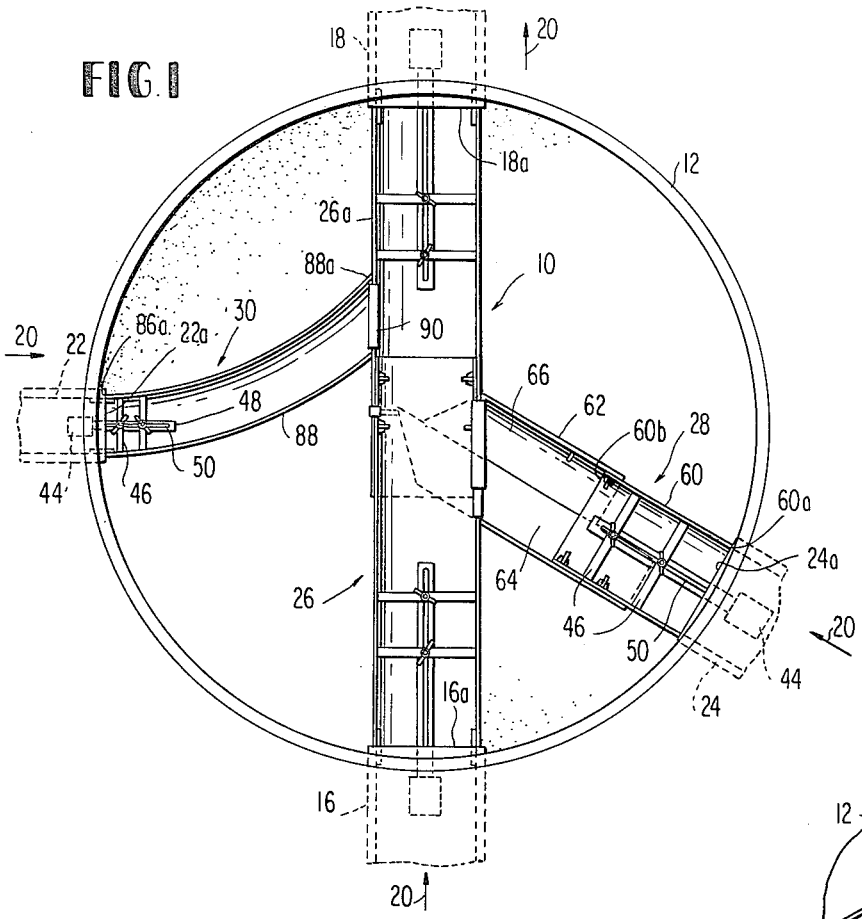
FIG. 4
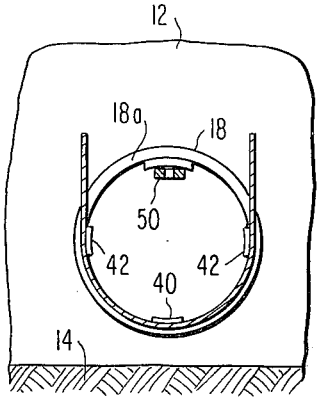
FIG. 2
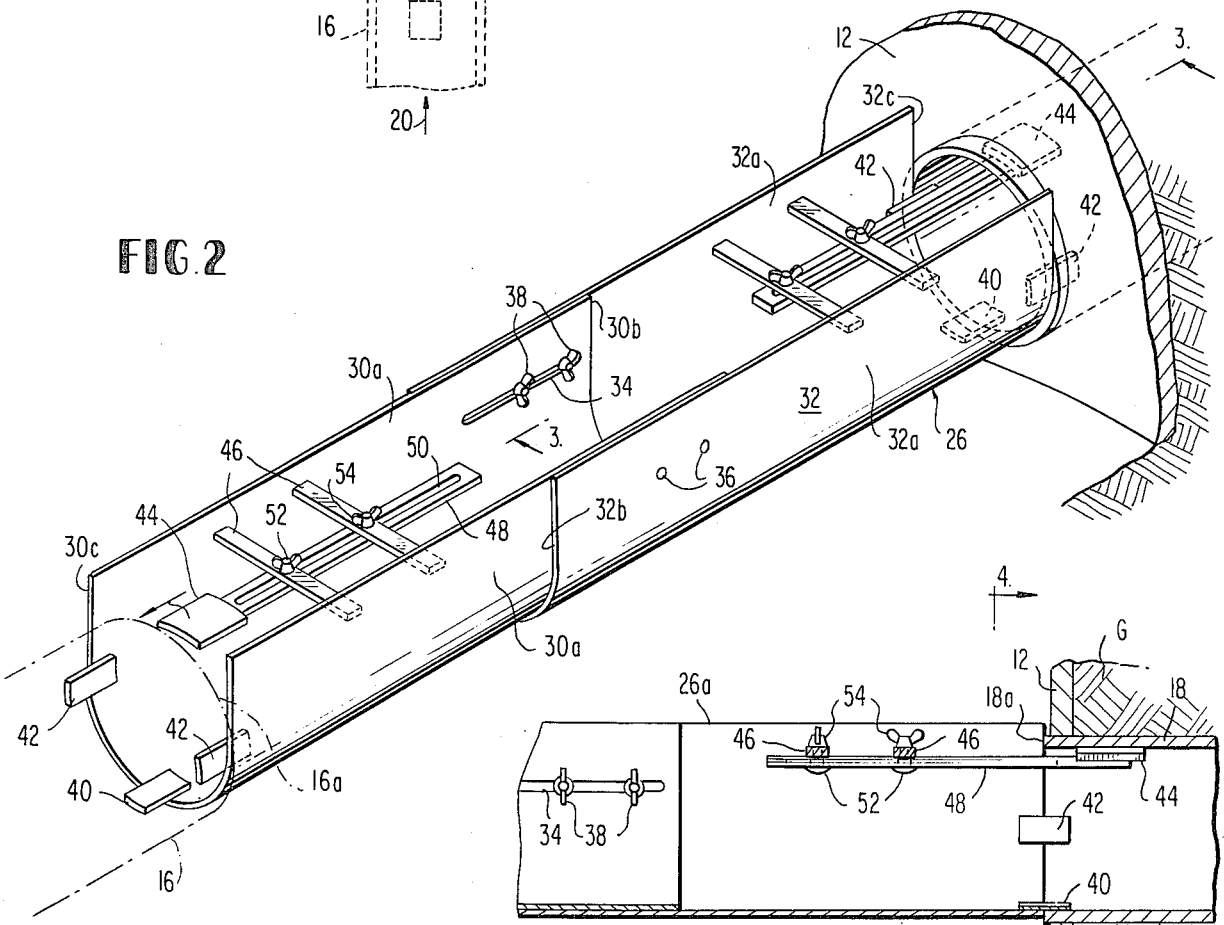
FIG. 3

FIG. 5
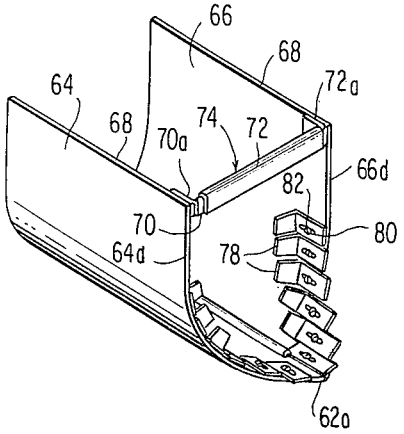
FIG. 8
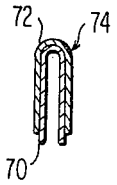
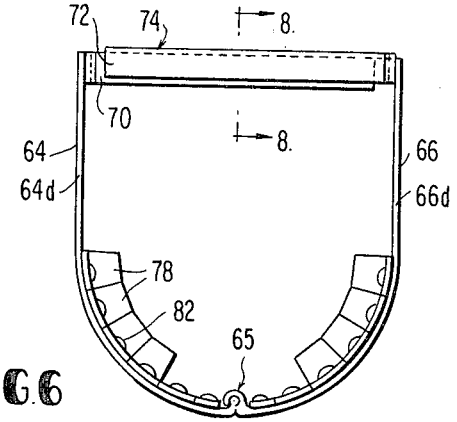
FIG. 6
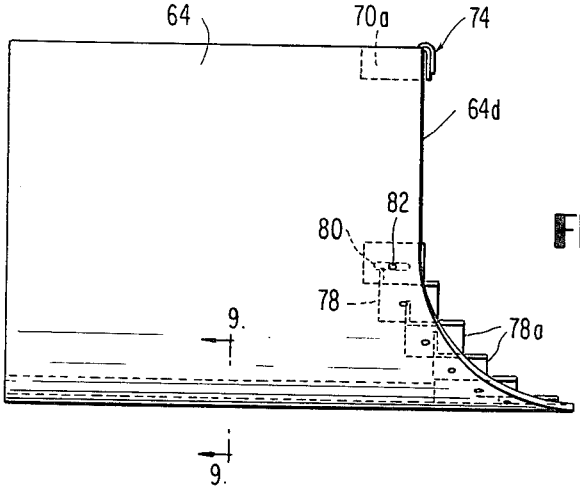
FIG. 7
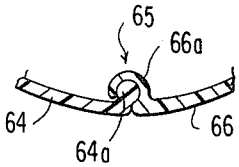
FIG. 9
FIG. 11
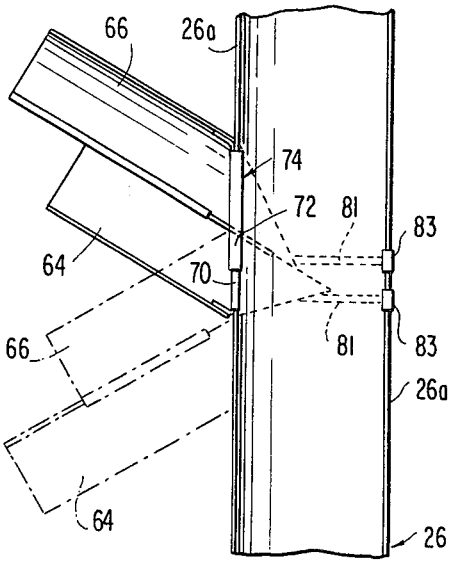
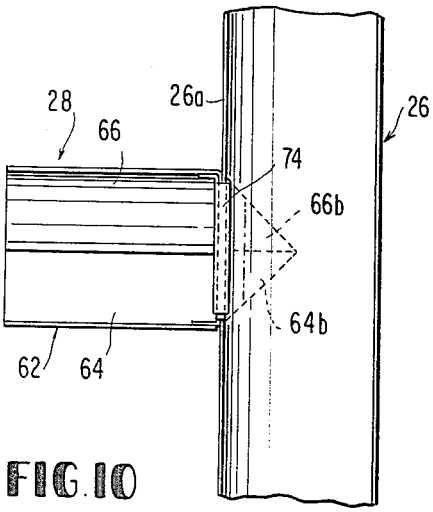
FIG. 10

FULL HEIGHT SEWER SYSTEM MANHOLE INVERT FORM ASSEMBLY WITH ANGULARLY ADJUSTABLE INTERSECTING FLOW PATH

FIELD OF THE INVENTION

This invention relates to the utilization of invert forms in defining U-shaped flow paths between various pipes opening interiorly of a cylindrical manhole, the paths being formed by pouring concrete within the manhole cylinder in the area not occupied by the forms. More particularly, the invention relates to a multi-form assembly adaptable to manholes of differing diameters and for connecting intersecting flow paths, portions of which may be straight or curved.

BACKGROUND OF THE INVENTION

Manholes constituting upright cylinders are located at various positions within a sewage system or the like, to define areas of intersection or access to given sewage flow paths as defined by the various pipes of a sewage system. For instance, such vertical wall manhole cylinders exist at points where several pipes merge, as for instance where two or more inlet pipes are connected to a single outlet pipe. Under such circumstances, the cylindrical manhole structure constituting a preformed concrete cylinder which defines a cylindrical internal cavity, is provided with circular openings within the wall of the same at some position above its bottom with the various concrete pipes terminating at the manhole cylinder and with the pipes opening to the interior of the manhole. The ends of the pipes may be flush with the sidewall or projecting slightly into the interior of the cavity defined by the manhole cylinder. In order to permit the inlet flows to merge and to flow through a common outlet, for instance, it is normal to employ wooden or partially wooden forms for defining troughlike connections between the pipes and to fill the interior of the manhole with the exception of the hollow trough forms with concrete, whereupon the forms "known as invert forms", are removed either after the concrete has fully hardened or at least partially hardened, whereupon semicircular cross-sectional intersecting trough flow paths are provided within the hardened concrete, with the tops of the troughs being open. The flow may enter from those pipes constituting the inlet pipes to the manhole, the flow merging at points where the trough paths intersect and continuing to a single outlet pipe circumferentially spaced from the single or multiple inlets.

Such flow paths have been inadequate to say the least since in most cases, the invert form permits the deposition of concrete only to the extent of creating semi-circular cross-sectional flow paths which rise approximately half the height of the pipes entering the manhole interior. Further, there is extreme difficulty in the creation of invert forms which in fact intersect at other than at right angles to each other or in which there is some curvature of flow relative to, for instance, a straight through flow path between diametrically opposed inlet and outlet pipes.

Additionally, while the wooden or plastic and wooden invert forms permit the creation of intersecting flow paths, that is, multiple inlets feeding to a common outlet or vice versa, the invert form assembly is limited to a single use. The form segments are not normally employable without alteration or essential reconstruction within other manholes of the sewage system, and particularly, the form assembly was not applicable to manholes of different diameter, different number and location of pipe openings to the interior of the manhole or for defining flow converging or diverging paths of differing angles of intersection.

SUMMARY OF THE INVENTION

The present invention is directed, in one aspect, to a full height manhole invert form permitting the creation of relatively large depth, open top, troughlike flow paths formed of poured concrete between an inlet and an outlet pipe within a manhole in which the height of the flow path is essentially equal to that of the pipes being connected. In a basic embodiment of the invention, the invert form assembly constitutes a straight through invert form for connecting diametrically opposed, axially aligned inlet and outlet pipes opening to the interior of a vertically oriented manhole cylinder and comprised of telescoping, U-shaped, slidable sections having a horizontal height and width approximately equal to the diameter of the aligned inlet and outlet pipes. Means are provided for locking the slidable sections such that the opposite ends of the slidable sections abut the projecting ends of the opposed inlet and outlet pipes. The U-shaped slidable telescoping sections bear laterally opposed invert side tabs and an invert bottom tab at 90° thereto, which project axially beyond the ends of the U-shaped invert telescoping slidable sections and which are borne on the inside wall of the invert form section and whose ends project within respective pipes to center the invert section such that the straight through invert form defines, when concrete is poured, a continuation flow path between the pipes. Transverse struts or the like support slide guides for longitudinal movement adjacent the top of the invert form at respective ends and each guide bears a retainer tab which is lockable in extended position within the pipes and in contact with the top of the pipes at respective ends to prevent rise of the invert form during pouring of concrete.

As another aspect of the present invention, the full height manhole invert form assembly is provided with an intersecting side flow invert form for mounting within the manhole and connecting a further pipe circumferentially displaced from the inlet and outlet pipes to the straight through invert form to form, upon concrete pouring, U-shaped trough flow paths. The intersecting side flow invert form assembly comprises telescoping U-shaped sections, including a first section being connected to the third pipe and a second telescoping section in contact with the straight through primary flow invert form. The second section is composed of interlocking, laterally opposed, axially slidable, edge interlocking, sidewall section halves. Means are provided for mounting the sidewall section halves for sliding movement together with respect to the one telescoping section and relative to each other to project respective sidewall section halves into surface contact with the side of the straight through primary flow invert form, regardless of the angle of intersection, within limits.

Preferably, each of the sidewall section halves terminates in a flexible lip to maximize edge contact between the sidewall section halves and the side of the straight through primary flow invert form. A plurality of L-shaped adjustable tabs are slidably mounted to the edges of sidewall section halves and may be adjustably projected with respect to the edge of said section halves to conform the leading edge to the abutting form, whereby the intersecting side flow invert form may be readily positioned at varying angles with respect to the straight through form with which it has intersecting contact.

Preferably, each of the sidewall section halves bears a flexible strap fixed at one end to the section half adjacent the flexible lip and bearing a U-shaped clip fastenable to the upper edge of the straight through invert form to the side opposite the area of contact of said intersecting side flow invert form. An inverted U-shaped telescoping transverse strut joins the opposed sidewall section halves at their ends in contact with the side of the straight through invert form, for clamping that end of the intersecting side flow invert form to the straight through invert form. A curved, telescoping, intersecting side flow invert form of given curvature bears an inverted U-shaped transverse strut across the top of the U-shaped curved telescoping section at an end opposite that joined to a pipe opening to the manhole, for coupling to the upper edge of the straight through primary flow invert form, permitting curved side intersecting flow from a given secondary flow pipe opening to the manhole at a circumferentially spaced position to one side of said aligned inlet and outlet pipes adjoined by the straight through primary flow invert form.

BRIEF DESCRIPTION OF THE DRAWINGS

FIG. 1 is a top plan view of a full height manhole invert form assembly with angularly adjustable intersecting flow paths forming one embodiment of the present invention.

FIG. 2 is a perspective view of the straight through primary flow invert form forming a portion of the invert form assembly of FIG. 1.

FIG. 3 is a vertical sectional view of a portion of the invert form of FIG. 2 taken about line 3—3 of FIG. 2.

FIG. 4 is a vertical sectional view of a portion of the invert form of FIG. 3 taken about line 4—4.

FIG. 5 is a perspective view of a portion of one section of the intersecting side flow invert forms of the assembly of FIG. 1.

FIG. 6 is an enlarged end view of the side flow invert form section of FIG. 5.

FIG. 7 is a side elevational view of the section of the invert form of FIGS. 5 and 6.

FIG. 8 is a vertical sectional view of the telescoping strut of FIG. 6 taken about line 8—8.

FIG. 9 is an enlarged, vertical sectional view of the slide interlock between the sidewall section halves of FIG. 7 taken about line 9—9.

FIG. 10 is a top plan view of the invert section of FIG. 5 of an intersecting side flow invert section of FIG. 5 mounted to the straight through primary flow invert form of FIG. 2, with flow intersection at right angles.

FIG. 11 is a top plan view of the assembly shown in FIG. 10 with the intersecting side flow invert form intersecting the straight through primary flow invert form at approximately 60°, shown in full lines, with the opposite angular inclination of 60° shown in dotted line form.

DESCRIPTION OF THE PREFERRED EMBODIMENTS

Reference to FIG. 1 illustrates a typical invert form assembly indicated generally at 10 in accordance with the present invention as applied to a manhole consisting of a precast concrete member or manhole cylinder as at 12 oriented vertically and set within the ground G to the extent that member forms a manhole ground floor 14. The manhole cylinder 12 bears a plurality of circular holes or openings 15 within which various pipes project and open to the interior of the manhole cylinder 12. The manhole cylinder therefore functions to connect flow paths as defined by the various pipes feeding to the manhole cylinder 12. In this respect, a first inlet pipe 16 opens to the interior of the manhole having an end 16*a* projecting within the interior of the cylinder 12, opposite a second pipe 18. Pipe 18, in this case, functions as the single outlet and having its end 18*a* diametrically opposite and in alignment with the end 16*a* of the inlet pipe 16. Pipes 16 and 18 define a straight through, primary flow path for the sewage which flows in the direction of arrows 20 between these two pipes.

To the left, FIG. 1, there is a third pipe 22 acting in this case also as a secondary inlet pipe and having an end 22*a* opening to the interior of the manhole cylinder 12. A fourth pipe 24 also constituting an inlet pipe opens into the interior of the cylinder 12 at end 24*a*. The axis of pipe 22 is essentially at right angles to the flow path between inlet pipe 16 and outlet pipe 18. The flow path for inlet pipe 24 is approximately 60° to the center line between the inlet pipe 16 and the outlet pipe 18.

The invert form assembly 10 shows three principal aspects of the present invention. The first aspect is the longitudinally adjustable straight through invert form indicated generally at 26, which connects inlet pipe 16 to outlet pipe 18. A second aspect in terms of the angular intersecting side flow invert form indicated generally at 28 which connects the inlet pipe 24 to the straight through primary flow invert form 26, and a third aspect being the arcuate, intersecting side flow invert form indicated generally at 30 and connecting the inlet pipe 22 to the straight through primary flow invert form 26, but because of the curvature of the form 30, permitting a smooth transition flow from pipe 22 with the flow from inlet pipe 16 and side flow pipe 24, downstream of the point of intersection of flow from pipes 16 and 24. All of the three invert forms 26, 28 and 30 are U-shaped in transverse section. They are open at the top and their function is to define intersecting trough flow paths of the same configuration formed by concrete set within the cylinder 12 to a level which is preferably just beneath the upper edges 26*a*, 28*a* and 30*a*, respectively, of these invert forms and which fill the complete interior of the manhole 12 with the exception of the U-shaped trough area defined by the invert forms 26, 28 and 30.

As a basic aspect of the present invention, reference may be had to FIGS. 2, 3 and 4 which show that make up and the adjustable nature of the straight through invert form 26. The straight through invert form 26 is actually formed of two telescoping sections: a straight through male form section 31 and a straight through female section 32. These sections and forms 28 and 30 are formed of fiberglass, relatively rigid plastic, sheet metal or the like. The section 31 is provided with laterally opposed, vertical sidewall portions as at 31*a*, these sidewall portions bearing laterally opposed elongated slots 34, end 31*b* remote from pipe 16. The female section 32 includes opposite sidewalls 32*a*, these sidewalls bearing inwardly projecting threaded bolts 36, the bolts being longitudinally aligned and projecting through the slots 34 of the male section 30 and bearing wing nuts 38, such that the two sections 30 and 32 may be extended and retracted within limits defined by the length of the slots 34 and locked in position. Thus, the straight through invert form is adaptable to manhole cylinders of varying diameter. Further, the opposite ends 31*c* and 32*c* of respective sections bear on their inner surfaces, a plurality of thin, short length strips constituting invert tabs, including a bottom invert tab 40 and oppositely oriented invert side tabs as at 42 for both members. The invert tabs 40 and 42 are fixed to the inner surface of the straight through invert form sections 30 and 32. If metal, the tabs may be welded to these members, such that portions of the tabs project beyond the ends of the form sections. These tabs are received within the interior of the pipes as at 16 and 18, FIG. 2, thus centering the straight through invert form and maintaining axial alignment thereof with respect to the pipes. In order to secure the invert form and to prevent its floating upwardly as a result of pouring of concrete within the space formed by the manhole cylinder bottom not occupied by the form assembly 10, all three invert forms 26, 28 and 30 are provided with suitable retainer tabs as at 44. In the case of the straight through primary flow invert form 26, a pair of struts or slide guide support arms 46 are fixedly coupled at their ends to opposed sides 31*a* of section 31 and to opposed sides 32*a* of section 32 near respective ends 31*c*, 32*c* of these members. The retainer tabs 44 are curved members or strips borne at one end of slide guides 48, which guides 48 are slotted throughout the major portion of their length, as at 50, and through which bolts 52 project, the bolts bearing wing nuts as at 54, such that the slide guides 48 can be locked at adjustable longitudinal positions with the retainer tabs 44 positioned interiorly of the pipes. To the right, FIG. 2, the retainer 44 is within its pipe 18, and to the left in that figure, tab 44 lies outside of pipe 16 at that moment. By loosening the wing nuts 52, the leftmost slide guide 48 can be shifted to the left to place its retainer tab 44 beneath and in contact with the top of pipe 16 adjacent its end 16*a*. The position occupied by the invert form permits the formation of a highly satisfactory, full height liquid flow trough or channel in concrete upon the filling of the concrete (not shown) to the level approximating the edge 26*a* of that invert form, FIG. 3. The achieving and maintaining of the centering of that form and the prevention of its rise may also be appreciated by further reference to FIGS. 3 and 4. Suitable seals may be easily made in the areas A of FIGS. 2 and 4, if necessary, to prevent excessive concrete from seeping into the interior of the invert form 26 during the pouring of concrete, the same being true for invert forms 28 and 30 of the complete form assembly 10.

Turning next to FIGS. 5 through 11 inclusive, a second important aspect of the adjustable invert form assembly and the ready change in angulation of merging or diverging flow paths, provided by angular, intersecting side flow invert form 28. From FIG. 1, it may be seen that the invert form 28 comprises two telescoping sliding sections: a radially outboard section indicated generally at 60 and a radially inboard section indicated generally at 62. Section 60 has one end 60*a* in abutment with the end 24*a* of inlet pipe 24, its opposite end 60*b* terminates within and is slidably accommodated by the female 62 of the two sections. In the method of locking and permitting slidable extension and retraction of these two sections through the employment of slots, bolts and wing nuts in the identical form to that of invert form 26, may be seen in FIG. 1 and like elements bear like numbers. Further, the transverse struts 46 are identical to those for invert form 26 and slidably mount the slide guide 50, which in turn supports at one end the retainer tab 44 which contacts the interior of the pipe 24 at its top and assists in centering the outboard end of the invert form 28 along with suitable side and bottom tabs (not shown).

The variation in this case resides in the make up of inboard or female section 62. This section 62, contrary to the invert form 26, while being U-shaped in overall configuration, is formed of two separate and axially shiftable, interlocking sidewall section halves as at 64, 66, FIG. 3. It is these section halves which may be best seen in FIGS. 5–11 inclusive. The sidewall section halves, while vertical and flat near their open upper edges as at 28*a*, are rounded at the bottom and terminate in a tongue and groove joint 65 defined by a tongue 64*a* for section half 64 and a rounded groove element 66*a* for section half 66. The cross-sectional view, FIG. 9, shows the left and right sidewall section halves as being formed of plastic. Further, the tongue and groove joint terminates some distance rearward from the tip 62*a* of this female section 62. Further, for both sidewall section halves, the tip portions thereof are formed of a material which is much more flexible than that of the body remote of the tip, that is, portions 64*b* and 64*c*, FIG. 7, are of flexible plastic, for instance. This permits the tips to be pulled into full edge contact with the outside wall surface of the invert form 26 with which it abuts at various angles. Preferably, the opposed vertical sidewall section halves of section 62 are joined at their tops by a telescoping strut, indicated generally at 72, adjacent leading edges 64*d* and 66*d*, which contact the straight through invert form (or even a curved invert form with which the angularly adjustable side flow invert form 28, during the construction of a suitable invert form assembly determined by the number and location of the various pipes opening to the interior of the manhole cylinder 12 and the nature of the desired intersecting flow paths).

A pair of inverted U-shaped strips as at 70 and 72 are cantilever mounted by way of tabs or bases 70*a* and 72*a*, respectively, to the respective opposed sides of the section 62 at the upper corners adjacent edges 64*d* and 66*d*, respectively, to form telescoping strut 74. The two sidewall section halves 64 and 66 may be slid longitudinally relative to each other through the tongue and groove joint 64 with the telescoping strut expanding or contracting to conform to the angulation of these members with respect to the axis of the invert form with which they make connection.

Further, advantageously, since the telescoping strut is made of inverted U-shaped members, in which the inner of the two members 70 defines a cavity 76, this telescoping strut functions as a clip acting to receive an upper edge of the U-shaped invert form such as form 26 with which it makes contact and supports the inboard end of the invert form 28 which projects from one of the pipes as at 24, opening up to the interior of the manhole cover inwardly of that pipe end 24*a*. The versatility of the form 28 and its ready connection to another form such as a straight through form 26 may be seen by contrasting FIGS. 1, 5, 10 and 11.

Since the invert form 28 contacts the side of the straight through form 26, for instance, at differing angles, it is necessary to vary to some degree the overall configuration of the leading edges as at 64*d* and 66*d* of sidewall section halves 64 and 66, making up this member, which slide relative to each other. In that regard, each of the sidewalls is provided with a plurality of L-shaped metal or plastic tabs 78, which may be flexible and which bear slots as at 80. The tabs 78 are mounted by way of pins 82 projecting from the interior of the sidewall section halves for longitudinal shifting via slots 80, such that the edges of the tabs 78*a* extend beyond the curved portion of the edges 64*d* and 66*d* of the given sidewall section halves of this form section. It is preferable to omit tabs at the very bottom tip of the flexible tip portions 64*b* and 66*b* of these members, since the tip ends of these sidewall section halves are fairly flexible and readily permit the forms to contact each other and to effect the creation of smooth surface troughs within the poured concrete (not shown). Preferably, each of the sidewall section halves 64 and 66 are provided with a nylon strap 81 which extends from points near or just behind the flexible tip portions of the sidewall section halves, the straps bearing U-shaped metal clips 82 at their free ends which clamp to the upper edge of the U-shaped invert forms on the side opposite the inverted U-shaped telescoping strut, as best seen in FIGS. 1 and 11.

Further, if necessary, additional sealing elements such as adhesive strips or the like, may be employed to seal the area of contact between the invert forms, particularly where they meet at an oblique angle with respect to each other to provide a smooth contour to the formed trough resulting from the poured concrete without material surface deformation along the flow surface defined by the forms, at the flow path intersecting areas.

If desired, wing nuts may be provided for locking the L-shaped tabs at desired variable set positions to create a leading edge variation to the sidewall section halves of section 62 of form 28, depending upon the angle of inclination of form 28 with respect to the form which it intersects, as for instance form 26, FIG. 1. However, as shown, headed brads 82 permit the tabs 78 to be somewhat loosely mounted by way of the slots 80 so that the L-shaped tabs may be readily slidably shifted such that their leading edges 78*a* contact the side of the invert form.

The flexibility of the angularly shiftable invert form 28 may be seen further by reference to FIGS. 10 and 11. In the alternate embodiments of the invention assembly, the straight through invert form 26 in this case has one intersecting side flow at right angles to the main flow stream in which case the side flow invert form 28 is mounted to the left and would be connected at one end, for instance, to a pipe such as pipe 22, FIG. 1. In this case, the sidewall section halves 64 and 66 are directly oppositely aligned and terminate such that the strut 74 is at right angles to the axis of the invert form 28 and is clipped to the upper edge 26*a* of that member. The flexible tips 64*b* and 66*b* make ready contact with the curved sidewalls of the U-shaped invert form 26, the L-shaped tabs may be simply slid rearwardly or internally within the invert form section 62 and the nylon straps and clips carried thereby are not necessarily employed, particularly since there is no stress to the flexible tip portions 64*b* and 66*b* of sidewalls 64 and 66 of that form.

However, by reference to FIG. 11, in an alternate configuration for the invert form assembly from that shown at 10 in FIG. 1, sidewall section half 66 has been shifted longitudinally with respect to sidewall section half 64 of section 62, that is, slid forwardly, the telescoping strut 74 has been elongated and now is at an oblique angle with respect to these sidewall section halves with the telescoping strut sections 70 and 72 being extended with respect to each other. Further, it is necessary to employ the nylon strap 81 and its clip 82 to engage an opposite edge 26*a* of the straight through form 26 from that receiving the inverted U-shaped telescoping strut 74. Necessarily, the L-shaped tabs 78 will be shifted on their brads 82 to conform as closely as possible the leading edges 66*d* of the section halves 64 and 66 to the abutting side of the straight through invert form 26. As shown in the dotted lines in FIG. 11, the angulation can be shifted in this case by 60° simply be telescoping the strut members 70 and 72 of the strut 70 and then extending them again after sidewall section half 64 is shifted forwardly with respect to its counterpart 66 and continues in this forward movement, beyond the point in which the sidewall section halves are oppositely aligned to each other, as in FIG. 10, to reach the dotted line position of FIG. 11. The nylon strap 81 and the clip 82 remain in place with the clip 82 mounted to the edge 26*a* to form 26 but shifting longitudinally slightly in position, moving from the lower, full line position to the upper, dotted line position.

Turning next to FIG. 1, there is shown an intersecting side flow invert form 30 which constitutes dual telescoping arcuate or curved, U-shaped, upwardly open metal, plastic or fiberglass sections 86 and 88. Section 88 bears at one end 88*a* a transverse strut 90, at the top thereof, which is U-shaped in cross-section, opens downwardly, and readily clips to the upper edge 26*a* of the straight through invert form 26. At the opposite end of form 30, the unitary sheet material form section 86 bears in the fashion of the prior forms, laterally opposed invert side tabs 42, a bottom invert tab (not shown), and additionally bears a retainer tab 44 supported by a slide guide 48 which in turn is longitudinally adjustable by means of a slot 50 therein. Bolts which project through the pair of struts 46 and which carry on their threaded ends wing nuts locking the slide guide 50 at a position such that the retainer tab 44 is projected internally of pipe 22, that is, inwardly from end 22*a* of the pipe opening to the interior of the cylinder 12.

Additionally, the curved invert form 30 being sectionalized, comprises extendable and retractable male and female sections identical to the straight through form 26, FIG. 2, with the exception that the sections are of similar configuration and permitting the curved form to be adapted to manhole cylinders of varying diameter. In this case, the sections are extended until one end 88*a* of section 88 contacts the side of the straight through invert form 26 with which the connection is made, and the end 86*a* of section 86 contacts a pipe such as pipe 22, opening to the interior of the manhole and acting as either the inlet or outlet to the intersecting flow area. Alternatively, the curved invert form may include duplicate opposite ends for coupling directly between two non-aligned pipes opening to the manhole interior at circumferentially spaced positions.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An improved, full pipe height manhole invert form assembly for creating an open top, troughlike flow path formed of poured concrete between at least an inlet and an outlet pipe within a manhole, said invert form assembly comprising:

a straight through primary flow invert form for connecting diametrically opposed axially aligned inlet and outlet pipes opening to the interior of the manhole, said form comprising telescoping, U-shaped, upwardly open, slidable invert form sections having a height and width approximately equal to the diameter of the aligned inlet and outlet pipes, means for locking the slidable sections in positions such that the opposite ends of the form abut projecting ends of the opposed inlet and outlet pipes, laterally opposed invert side tabs fixed to the ends of respective sections and projecting beyond the ends thereof and being received within the interior of respective inlet and outlet pipes, and invert bottom tabs fixed to the interior of the sections at their ends and having a portion projecting longitudinally thereof beyond the edge of said sections and contacting the interior of the pipes at their bottoms, respectively, so as to center the invert form with respect to said aligned pipes, and a longitudinally adjustable slide guide mounted at respective ends of said invert form at the top thereof and bearing a retainer tab centered transversely of said invert form section and projectable interiorly of said pipes to contact the inner surface of the pipes at the top thereof to prevent lifting of the invert form during pouring of the concrete to form U-shaped trough flow paths between said pipes upon hardening of the concrete, and wherein said means for supporting said slide guide at respective ends of said straight through invert form comprises laterally extending, spaced struts, said slide guide being slotted longitudinally, bolts projecting through said struts and being received within said slots, nuts threadably carried by said bolts, whereby, upon loosening of said nuts, said slide guide may be slid longitudinally to project said retainer tab at a variable distance into the open end of pipe in contact therewith, whereupon said nuts can be tightened down to lock said retainer tab at a given distance from said struts.

2. The invert form assembly as claimed in claim 1, wherein said manhole further comprises a third pipe opening to the interior of the manhole, in the plane of the inlet and outlet pipes and being circumferentially spaced with respect thereto, and wherein said assembly further comprises an intersecting side flow invert form mounted within the manhole and connecting said third pipe to the side of the straight through invert form to form, upon concrete pouring, intersecting U-shaped trough flow paths, said intersecting side flow invert form assembly comprising telescoping U-shaped sections including a first section connected to said third pipe and a second telescoping section in contact with the straight through primary flow invert form, said second section being composed of interlocking, laterally opposed axially slidable edge interlocking side wall section halves, means for mounting said sidewall section halves for sliding movement together with respect to said first telescoping section and relative to each other to project the respective sidewall section halves into surface contact with the side of the straight through primary flow invert form over varying angles of intersection with respect to said invert forms.

3. The invert form assembly as claimed in claim 2, further comprising an inverted, U-shaped, telescoping transverse strut joining the opposed sidewall section halves at their ends in contact with the side of the straight through invert form at the top thereof for clamping that end of the intersection side flow invert form to the straight through invert form.

4. The invert form assembly as claimed in claim 3, wherein each of said sidewall section halves terminates at the end in contact with the straight through primary flow invert form in a flexible lip to maximize edge contact between the sidewall section halves and the side of the straight through primary flow invert form.

5. The invert form assembly as claimed in claim 4, further comprising an inverted, U-shaped, telescoping transverse strut joining the opposed sidewall section halves at their ends in contact with the side of the straight through invert form at the top thereof for clamping that end of the intersection side flow invert form to the straight through invert form.

6. The invert form assembly as claimed in claim 4, further comprising a plurality of L-shaped, adjustable tabs slidably mounted to the sidewall section halves along the edge in contact with the side of the straight through primary flow invert form, such that by shifting the tabs longitudinally, the contour of the edge may be varied to conform that contour to the straight through form depending upon the angle of intersection therewith.

7. The invert form assembly as claimed in claim 6, wherein each sidewall section half bears a flexible strap, fixed at one end to the section half adjacent the flexible lip and bearing a U-shaped clip at its opposite, free end for fastening to the upper edge of the straight through invert form to the side opposite the line of contact between said intersecting side flow invert form and the straight through invert form.

8. The invert form assembly as claimed in claim 7, further comprising an inverted, U-shaped, telescoping transverse strut joining the opposed sidewall section halves at their ends in contact with the side of the straight through invert form at the top thereof for clamping that end of the intersection side flow invert form to the straight through invert form.

* * * * *